US009776686B2

(12) United States Patent
Sizemore

(10) Patent No.: US 9,776,686 B2
(45) Date of Patent: Oct. 3, 2017

(54) MODULAR WATERCRAFT WITH IN-LINE OR PONTOON-TYPE FLOTATION

(71) Applicant: Formex Manufacturing, Inc., Lawrenceville, GA (US)

(72) Inventor: Thomas Wade Sizemore, Oxford, GA (US)

(73) Assignee: Formex Manufacturing, Inc., Lawrenceville, GA (US)

( * ) Notice: Subject to any disclaimer, the term of this patent is extended or adjusted under 35 U.S.C. 154(b) by 1 day.

(21) Appl. No.: 14/958,181

(22) Filed: Dec. 3, 2015

(65) Prior Publication Data

US 2017/0158287 A1 Jun. 8, 2017

(51) Int. Cl.

| | |
|---|---|
| ***B63B 3/08*** | (2006.01) |
| ***B63B 35/34*** | (2006.01) |
| ***B63B 35/71*** | (2006.01) |
| ***B63B 5/24*** | (2006.01) |
| *B63B 29/04* | (2006.01) |

(52) U.S. Cl.

CPC ..... *B63B 3/08* (2013.01); *B63B 5/24* (2013.01); *B63B 35/34* (2013.01); *B63B 35/71* (2013.01); *B63B 2003/085* (2013.01); *B63B 2029/043* (2013.01)

(58) Field of Classification Search

CPC ..... B63B 3/08
USPC ..... 114/353–354
See application file for complete search history.

(56) References Cited

U.S. PATENT DOCUMENTS

| | | | |
|---|---|---|---|
| 299,951 | A | 6/1884 | Brown |
| 1,552,751 | A | 9/1925 | Marriott |
| 1,620,867 | A | 3/1927 | Boyle |
| 1,657,786 | A | 1/1928 | Carmichael |
| 1,785,971 | A | 12/1930 | O'Connor |
| 2,216,871 | A | 10/1940 | Banks |
| 2,309,416 | A | 1/1943 | Michele |
| 2,377,963 | A | 6/1945 | Rabjohn |
| 2,485,446 | A | 10/1949 | Jackson |
| 2,674,753 | A | 4/1954 | Wood |
| 2,894,270 | A | 7/1959 | Manthos |
| 2,946,068 | A | 7/1960 | Jasper |
| 3,093,843 | A | 6/1963 | Oman |
| 3,119,128 | A | 1/1964 | Edmonson |
| 3,175,234 | A | 3/1965 | Kutsi |
| 3,182,628 | A | 5/1965 | Sebastian |

(Continued)

FOREIGN PATENT DOCUMENTS

| | | | |
|---|---|---|---|
| CH | 105737 | A | 7/1924 |
| DE | 102013011030 | A1 | 1/2015 |

(Continued)

*Primary Examiner* — Lars A Olson
*Assistant Examiner* — Jovon Hayes
(74) *Attorney, Agent, or Firm* — Kilpatrick Townsend & Stockton LLP; Dean W. Russell

(57) ABSTRACT

Watercraft with dual, in-line flotation are detailed. Front and rear floats may be bridged by a seating assembly and allow both feet-up and feet-down positioning of a user of the craft. The watercraft may be disassembled and then reassembled compactly for transport or storage, with the compactly reassembled craft including wheels or capable of being placed onto a hand trolley if desired to facilitate its carriage. Also detailed are watercraft in which forward flotation is provided by two front floats forming a pontoon configuration.

15 Claims, 10 Drawing Sheets

(56) References Cited

U.S. PATENT DOCUMENTS

| | | | | | |
|---|---|---|---|---|---|
| 3,321,784 | A | | 5/1967 | Rasmussen | |
| 3,381,322 | A | * | 5/1968 | Cook | B63B 7/04 114/352 |
| 3,471,875 | A | | 10/1969 | Lyon | |
| 3,490,085 | A | | 1/1970 | Lewis | |
| 3,548,428 | A | | 12/1970 | Eades | |
| 3,593,684 | A | | 7/1971 | Cogliano | |
| 3,883,909 | A | | 5/1975 | Fisher et al. | |
| 4,192,249 | A | | 3/1980 | Vidal | |
| 4,362,517 | A | | 12/1982 | Martin | |
| 4,522,143 | A | | 6/1985 | Holzbaur | |
| 4,794,876 | A | | 1/1989 | Levine | |
| 4,926,781 | A | | 5/1990 | Bauer | |
| 5,046,978 | A | | 9/1991 | Howerton | |
| 5,086,721 | A | | 2/1992 | Burkard | |
| 5,148,763 | A | | 9/1992 | White | |
| 5,171,178 | A | | 12/1992 | Creek et al. | |
| 5,239,940 | A | | 8/1993 | Griffin | |
| 5,297,978 | A | | 3/1994 | Ramsey | |
| 5,301,629 | A | * | 4/1994 | Kleyh | B63B 7/04 114/352 |
| 5,597,277 | A | | 1/1997 | Mayfield | |
| 5,643,031 | A | | 7/1997 | Fenton et al. | |
| 5,649,498 | A | | 7/1997 | Zigurs | |
| 5,692,450 | A | | 12/1997 | Alter et al. | |
| 5,833,502 | A | | 11/1998 | Anderson | |
| 5,868,097 | A | * | 2/1999 | Spickelmire | B63B 7/04 114/353 |
| 6,145,465 | A | | 11/2000 | Murphree | |
| 6,164,237 | A | | 12/2000 | Coryell et al. | |
| 6,325,013 | B1 | * | 12/2001 | Brown | B63B 7/04 114/352 |
| 6,367,405 | B1 | | 4/2002 | Smiley | |
| 6,500,034 | B1 | | 12/2002 | Lau | |
| 6,612,255 | B1 | * | 9/2003 | Wragg | B63B 7/04 114/352 |
| 6,662,743 | B1 | | 12/2003 | Rolfe | |
| 7,587,986 | B2 | | 9/2009 | Neidert et al. | |
| 8,167,667 | B2 | | 5/2012 | Sturm | |
| 8,292,683 | B2 | | 10/2012 | Axtell | |
| 8,327,792 | B2 | | 12/2012 | Ohman et al. | |
| 8,336,475 | B2 | | 12/2012 | Morin | |
| 8,783,203 | B1 | * | 7/2014 | Woods | B63B 7/04 114/352 |
| 2004/0038603 | A1 | | 2/2004 | Gaspar | |
| 2007/0289521 | A1 | * | 12/2007 | Fleming | B63B 7/04 114/353 |
| 2010/0024709 | A1 | | 2/2010 | Griffin | |
| 2010/0050922 | A1 | * | 3/2010 | Quigley | B63B 7/04 114/352 |

FOREIGN PATENT DOCUMENTS

| | | | |
|---|---|---|---|
| EP | 0118305 | B1 | 7/1989 |
| EP | 0945336 | B1 | 5/2004 |
| EP | 2679482 | A2 | 1/2014 |
| ES | 2192124 | A1 | 9/2003 |
| FR | 2650803 | A1 | 2/1991 |
| GB | 792129 | A | 3/1958 |
| GB | 846326 | A | 8/1960 |
| GB | 2292120 | A | 2/1996 |

* cited by examiner

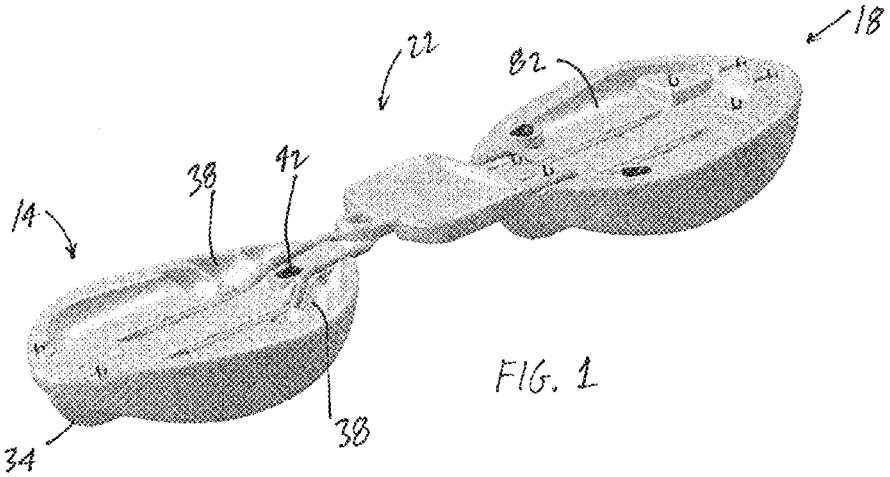
FIG. 1
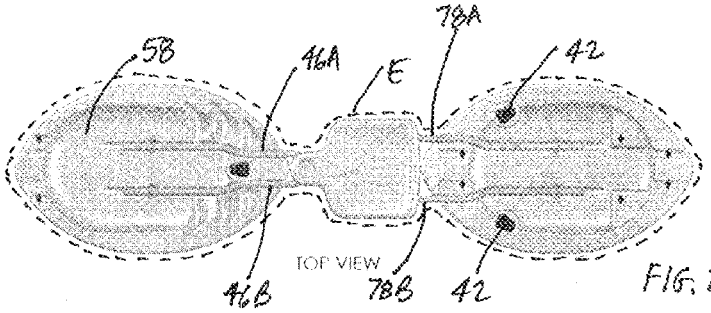
FIG. 2
FIG. 4
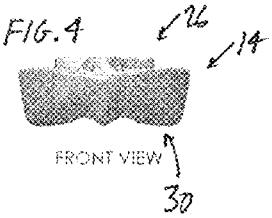
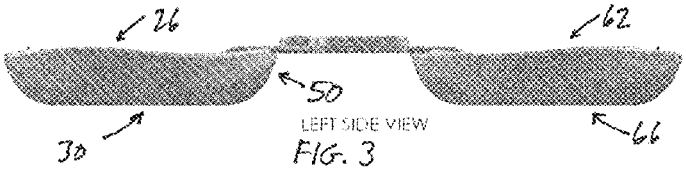
FIG. 3
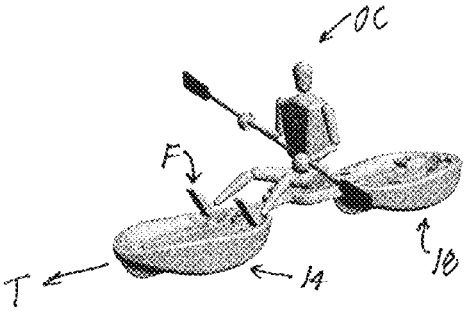
FIG. 5
FEET UP POSITION FOR PADDLING.
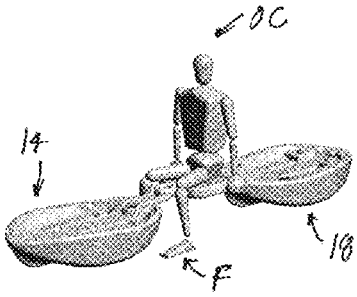
FEET DOWN POSITION FOR HANDS FREE MANEUVERING AND RELAXING.
FIG. 6

DISASSEMBLED INTO ITS MAIN COMPONENTS
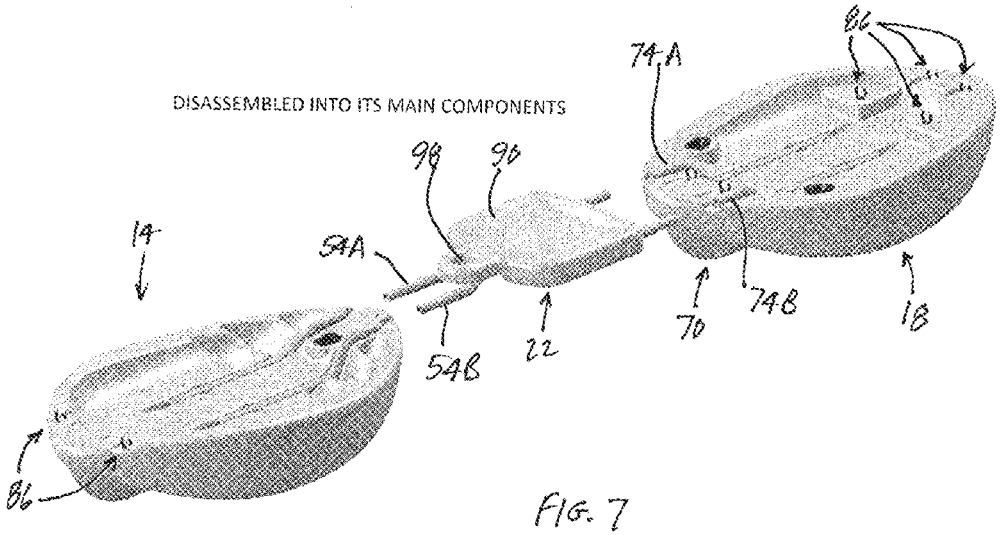
FIG. 7
REASSEMBLY INTO ITS COMPACT CONFIGURATION
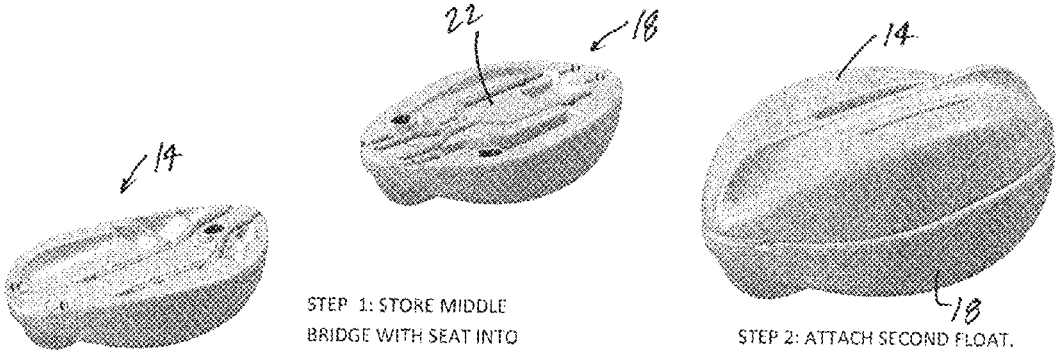
STEP 1: STORE MIDDLE BRIDGE WITH SEAT INTO FLOAT.
FIG. 8
STEP 2: ATTACH SECOND FLOAT.
FIG. 9

200
MOLDED FOOT WELLS 236
216
236
HANDLE
220
ALUMINUM ALLOY TUBULAR FRAME
WHEELS STORED WHILE ON WATER
216
208

204
FLUSH MOUNT ROD HOLDERS
MOLDED SEAT
212
CUP HOLDER
DECK PLATES
FRAME DESIGN ALLOWS
OCCUPANTS FEET ACCESS TO WATER
208
220
228
216
240
232

TOP VIEW
204
T
208
228
BACK VIEW

12"
216

SIDE VIEW
34"
134"
208
BOTTOM VIEW

204
FRONT VIEW

204

Front and back floats are removed from the mid-frame. Wheel assemblies are removed from back float.

Mid-frame with seat is clipped into the back float.

Front float is turned over and placed on back float and clips into place.

Wheel assemblies attach into frame of the back float.

The packed assembly can now be pulled around by the T-handle.

308
DRAIN PLUGS
304A
304B
MOLDED FOOT WELLS
ALUMINUM ALLOY TUBULAR FRAME
300
308
STAINLESS STEEL DRAW LATCHES
DECK PLATE FOR STORAGE ACCESS
MOLDED SEAT 312

304B
304A
T
PONTOON FLOAT CONFIGURATION ALLOWS FOR GREATER STABILIZATION

316C
DESIGN OF THE FRAME ALLOWS FOR THE OCCUPANT'S FEET ACCESS TO WATER
316
316A
TOP VIEW
316B
92"
SIDE VIEW

BACK VIEW

FRONT VIEW

96"
BOTTOM VIEW

FIG. 32: Disconnect the back float from the mid-frame.
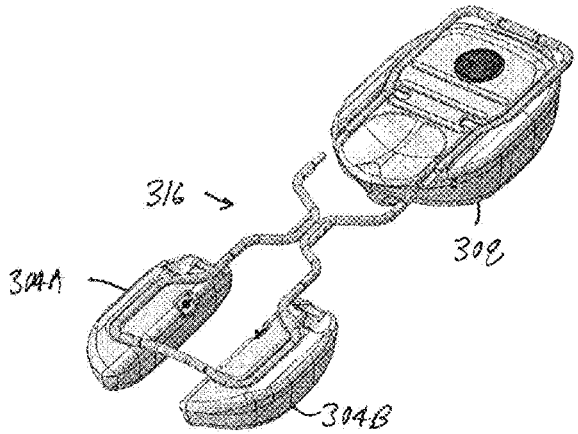
FIG. 33: Disconnect the front pontoon float assembly from the mid-frame.
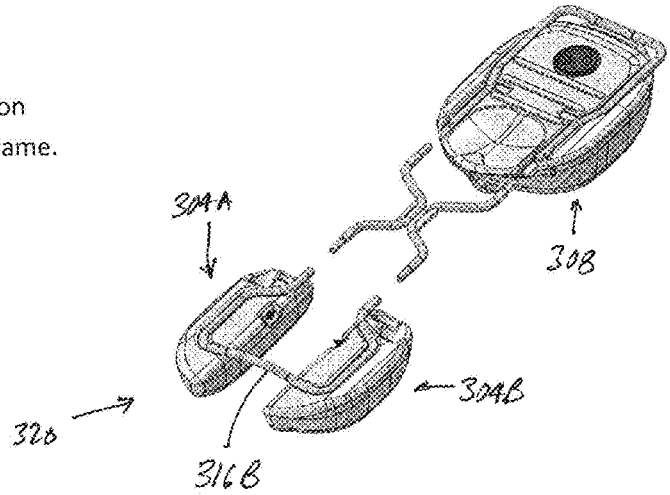

FIG. 34: Disconnect the right and left pontoons from the front cross bar.
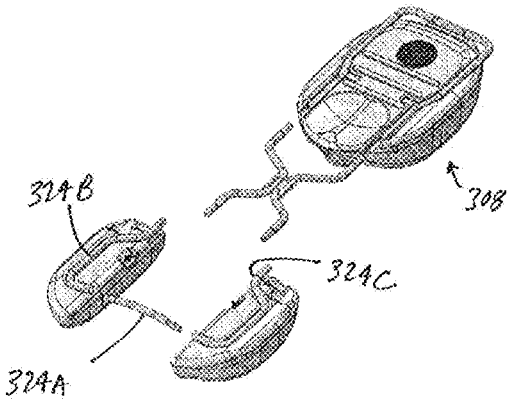
FIG. 35: Release the draw latches on the front of the back float and raise the lid.
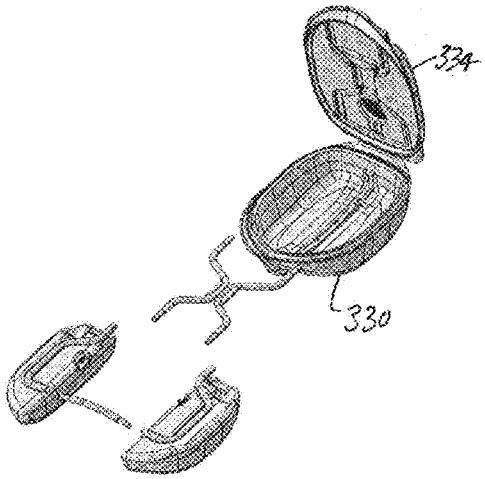
FIG. 36: The mid-frame clips into the underside of the lid.
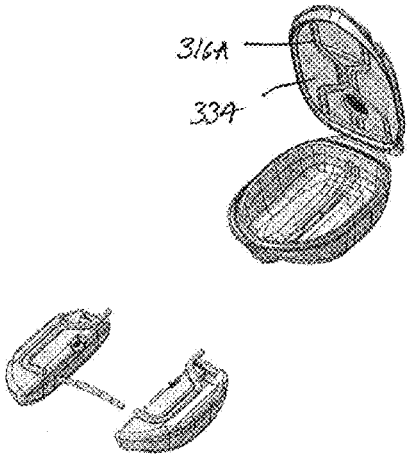

FIG.
37: The front cross bar fits into the bottom of the back float.
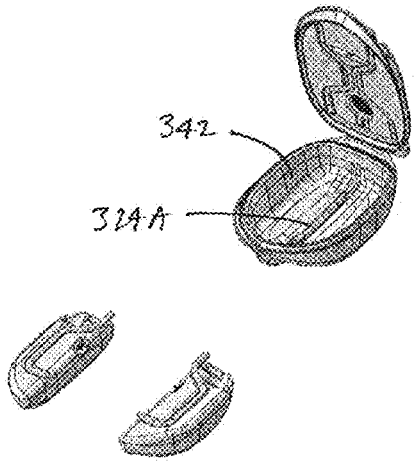
FIG.
38: The front left and right pontoons fit into the back float.
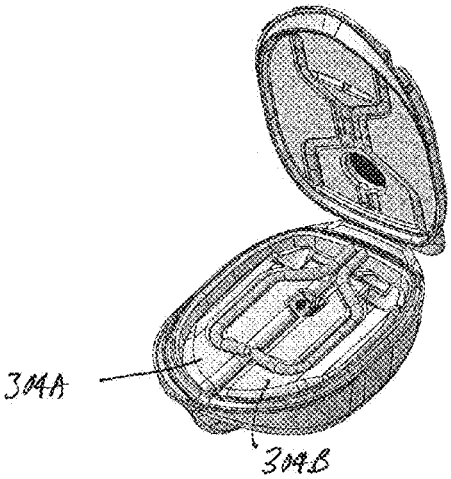
FIG.
39: Close the lid and secure it with the draw latches. The craft is now ready for storage and transport.
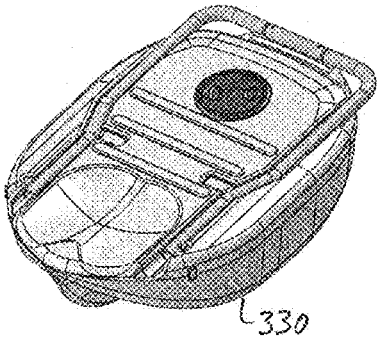

MODULAR WATERCRAFT WITH IN-LINE OR PONTOON-TYPE FLOTATION

FIELD OF THE INVENTION

This invention relates to watercraft and more particularly (but not necessarily exclusively) to such craft including in-line or pontoon-type flotation bridged by a seat, with the structure being separable and reconfigurable to facilitate transport and storage and accommodating feet of a user both atop a float (or floats) or in the water outside the footprint (envelope) of the craft.

BACKGROUND OF THE INVENTION

Watercraft that supposedly are easy to transport have long existed. U.S. Pat. No. 299,951 to Brown, dating from 1884, illustrates and describes a "hammock canoe" whose main frame includes handles and a strap. According to the Brown patent, "by the aid of" the handles and strap, "the person using the device may readily carry the same from place to place." See Brown, p. 1, 11. 79-83.

No disassembly of the canoe of the Brown patent is intended, however. Nor is the "canoe" intended to support a user in a seated or prone position while in the water; instead, the device is useable as a hammock (with a prone user) only when "cords or lines suspended from trees" are attached to its rings or loops. See id., 11. 36-38 and 87-92. Further, although the canoe includes an opening through which a user's legs may extend, the opening is entirely within the main frame, and thus within the footprint, of the canoe.

European Patent Publication No. 0118305 B1 (the "EP '305 Patent") also discloses what it calls an "easily transportable boat" with an integrated hull. The boat includes foot rests as well as hand grips and an opening within the envelope of the boat through which a user may place his or her legs. According to the EP '305 Patent: "When water less than three inches in depth is encountered the operator puts his feet through the opening, stands up, catches the hand grips and walks while carrying the boat at the same time until more suitable waters are reached." See EP '305 Patent, col. 3, 11. 57-61 (numerals omitted).

U.S. Pat. No. 2,674,753 to Wood and U.S. Pat. No. 2,946,068 to Jasper depict other water-borne objects, the former labelled a "boat" and the latter called a "float." The boat of the Wood patent is generally similar to the canoe of the Brown patent, although it also includes an inflatable "occupant support member" having a pair of holes through which a user's legs extend within the footprint of the boat. See Wood, col. 2, 11. 5-8; col. 3, 11. 4-14. The recreational float of the Jasper patent likewise includes a seat having leg openings bounded by an enclosure.

U.S. Pat. No. 3,093,843 to Oman, finally, describes yet another boat "which can be conveniently handled by a single person." See Oman, col. 1, 1. 15. The integrated structure of the boat includes two hull portions having internal air compartments for flotation and a saddle section for seating therebetween. See id., 11. 44-46. The entire contents of the Brown, Wood, Jasper, and Oman patents, together with the entire contents of the EP '305 Patent, are hereby incorporated herein by this reference.

SUMMARY OF THE INVENTION

Absent from these watercraft is any contemplation of disassembling components and reassembling them in compact configurations to aid their transport and storage.

Equally absent is any suggestion of reassembly involving fitting a seat frame into one float or fitting both a seat frame and one or more floats into a second float. In either case, the compactly reassembled structure may be connected to dedicated wheels or a hand trolley, for example, and rolled from place to place much like a conventional roll-aboard suitcase.

Versions of the inventive watercraft may resemble kayaks and be normally for personal use. At least some versions may include two floats aligned in the normal travel direction of the craft. These in-line floats preferably are rigid objects molded of buoyant plastic material, although other materials alternatively may be used. The floats may, if desired, be thermoformed. Alternatively, two forward floats may be used in a pontoon configuration together with at least one rear float.

Lower portions of the floats, which may contain keels, are designed to contact the water surface in use. By contrast, upper portions of the floats normally extend above the water surface. These upper portions may include passages (or other means) for receiving framework of an occupant seat. Foot wells also may be present in the nominally forward float, and either or both floats may include clips (or other means) for attaching one float directly to, or within, the other when compactly reassembled.

The occupant seating assembly may comprise a generally-horizontal seating platform to which the framework is connected. When prongs of the framework are positioned in passages of the floats, the seat may bridge the floats so that the occupant is positioned in-line with the floats. When the occupant faces in the normal direction of watercraft movement while seated on the seating platform, he or she may place his or her feet in the foot wells. This placement is especially well suited for rapidly paddling the craft, as the occupant's feet and legs will not create movement drag because extended into the water. By contrast, when maneuvering or anchoring the craft or while relaxing, the occupant may remove his or her feet from the foot wells and dangle his or her legs in the water outside the envelope of the watercraft while remaining seated.

A fully-functional, sleek personal watercraft thus may be formed of as few as three main components—two floats and a seat assembly. It may be disassembled merely by removing prongs of the seating framework from the passages of the two floats. In a first embodiment of the watercraft, the seating assembly may then be stored in recesses of the upper portion of one float and the second float thereafter clipped thereto. In a different embodiment, the combined seating assembly and (at least) one float may be fitted into the interior of the second float. Yet another embodiment allows two floats to be fitted into the interior of a float, while a seat remains external thereto. Each version produces a compact structure easy to transport and store.

It thus is an optional, non-exclusive object of the present invention to provide novel watercraft.

It also is an optional, non-exclusive object of the present invention to provide watercraft capable of being reconfigured either for use or for transport and storage.

It is another optional, non-exclusive object of the present invention to provide watercraft configured for compact reassembly to facilitate transport and storage.

It is, moreover, an optional, non-exclusive object of the present invention to provide watercraft having dual in-line floats bridged by a seating assembly.

It is yet another optional, non-exclusive object of the present invention to provide watercraft having pontoon-style, nominally forward floats detachably connected to a rear float.

It is an additional optional, non-exclusive object of the present invention to provide watercraft whose floats are rigid, molded plastics material.

It is a further optional, non-exclusive object of the present invention to provide watercraft in which at least one main component may be fitted into another during compact reassembly, with the compact result connected to wheels or a hand trolley if desired.

It is as well an optional, non-exclusive object of the present invention to provide watercraft in which a user alternatively may place his or her feet either in foot wells of a float (or floats) or in the water outside the envelope of the craft.

Other objects, features, and advantages of the present invention will be apparent to those skilled in the relevant art with reference to the remaining text and the drawings of this application.

BRIEF DESCRIPTION OF THE DRAWINGS

FIG. 1 is a perspective view of a first version of an exemplary watercraft encompassed by the present invention.

FIG. 2 is a top plan view of the watercraft of FIG. 1.

FIG. 3 is a side elevational view of the watercraft of FIG. 1.

FIG. 4 is a front elevational view of the watercraft of FIG. 1.

FIG. 5 is a perspective view of the watercraft of FIG. 1 also illustrating an occupant whose feet are positioned in foot wells of the craft.

FIG. 6 is a perspective view of the watercraft of FIG. 1 illustrating the occupant of FIG. 5 with his or her feet in positions normally extending into the water in which the craft is located.

FIG. 7 is an exploded perspective view of the watercraft of FIG. 1, with the seating assembly of the craft separated from the two floats.

FIG. 8 illustrates a first step in compactly reassembling the watercraft of FIG. 1 following the separation of FIG. 7.

FIG. 9 illustrates a second step in compactly reassembling the watercraft of FIG. 1 following the first reassembly step of FIG. 8.

FIG. 32 is an exploded perspective view of the watercraft of FIG. 26A-B, with a float of the craft separated from the other floats.

FIG. 33 illustrates a first step in compactly reassembling the watercraft of FIGS. 26A-B following the separation of FIG. 32.

FIG. 34 illustrates a second step in compactly reassembling the watercraft of FIGS. 26A-B following the first reassembly step of FIG. 33.

FIG. 35 illustrates a third step in compactly reassembling the watercraft of FIGS. 26A-B following the second reassembly step of FIG. 34.

FIG. 36 illustrates a fourth step in compactly reassembling the watercraft of FIGS. 26A-B following the third reassembly step of FIG. 35.

FIG. 37 illustrates a fifth step in compactly reassembling the watercraft of FIGS. 26A-B following the fourth reassembly step of FIG. 36.

FIG. 38 illustrates a sixth step in compactly reassembling the watercraft of FIGS. 26A-B following the fifth reassembly step of FIG. 37.

FIG. 39 illustrates a seventh step in compactly reassembling the watercraft of FIGS. 26A-B following the sixth reassembly step of FIG. 38.

DETAILED DESCRIPTION

Figure 10:
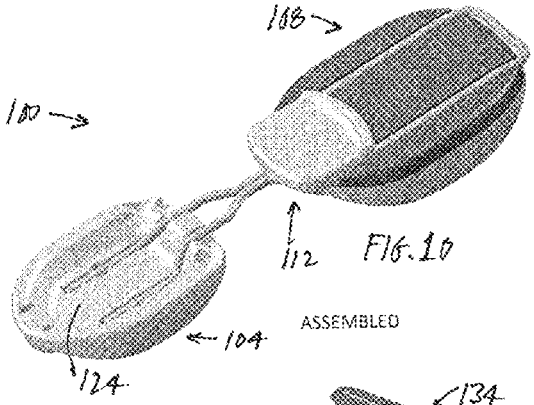
FIG. 10 is a perspective view of a second version of an exemplary watercraft encompassed by the present invention.

Depicted in at least FIGS. 1-6 is exemplary watercraft 10. Watercraft 10 may comprise first float 14, second float 18, and seating assembly 22. When watercraft 10 is assembled as shown in FIGS. 1-6, first float 14 and second float 18 are aligned in the normal travel direction T of the craft 10. A normally-seated user or occupant OC will face in that normal travel direction T (as illustrated in FIGS. 5-6), so that first float 14 extends forward of, and second float 18 extends rearward of, the occupant OC.

First and second floats 14 and 18 are buoyant so as to provide flotation for watercraft 10 when in water. They may be made of any suitable flexible or rigid material suitable for flotation. Preferably, however, floats 14 and 18 are molded of plastics material into rigid shapes, with their interior spaces filled with closed-cell foam or, less desirably, open-cell foam, air, or other buoyant material.

First float 14 may define upper portion 26 and lower portion 30. Lower portion 30 is designed to contact the water surface in use and may, if desired, include keel 34. Upper portion 26, by contrast, normally rides above the water line. Contoured into upper portion 26 may be various passages and recesses facilitating assembly and compact reassembly of the craft 10 as well as foot wells 38 and, optionally, fishing rod holder 42.

In particular, upper portion 26 may include spaced, parallel tunnels or passages 46A and 46B at its (nominal) rear end 50. Passages 46A and 46B may, in use, frictionally receive corresponding prongs 54A and 54B of seating assembly 22 so as to connect first float 14 and seating assembly 22 together. Upper portion 26 additionally may comprise central recess 58 into which a portion of seating assembly 22 may extend when craft 10 is reassembled compactly.

Second float 18 is generally similar to first float 14, in that it may define upper portion 62 normally riding above the water line and lower portion 66 normally contacting the water surface in use. Lower portion may, if desired, include keel 70.

Upper portion 62 may include parallel passages 74A and 74B. In use, these passages 74A and 74B frictionally receive corresponding prongs 78A and 78B of seating assembly 22 so as to interconnect second float 18 and seating assembly 22. Hence, merely by connecting seating assembly 22 to each of first float 14 and second float 18, a fully-functional, sleek watercraft 10 may be formed.

Also illustrated in connection with upper portion 62 are additional (optional) rod holders 42 and central recess 82. As with central recess 58, central recess 82 is configured to receive a portion of seating assembly 22 when craft 10 is reassembled compactly. One or more clips 86 may be present in or on each of first and second floats 14 and 18 so as to interconnect the floats in the compact configuration.

Seating assembly 22 may comprise seat 90 as well as framework 94. Seat 90 is a generally horizontal platform (which may if desired be contoured) designed to accommodate buttocks of occupant OC. Some versions of seat 90 may include molded-in cup holder 98.

Framework 94 attaches to seat 90 in any suitable manner. Alternatively, framework 94 may be integrally molded with seat 90. In either circumstance, framework 94 may include prongs 54A, 54B, 78A, and 78B so as to connect seating assembly 22 with each of first float 14 and second float 18.

FIGS. 5-6 illustrate watercraft 10 with occupant OC seated on seat 90. In FIG. 5, occupant OC is paddling craft 10 so as to move the craft 10 in travel direction T. For greater comfort and avoidance of drag while paddling, occupant OC may place his or her feet F in foot wells 38 of upper portion 26 rather than in the water. By contrast, while maneuvering, relaxing or resting, or otherwise when desired, occupant OC may alternatively place his or her feet F in the water as shown in FIG. 6. Such foot placement is outside envelope E (see FIG. 2) of watercraft 10 and thus easily accomplished.

Disassembly and compact reassembly of watercraft 10 is depicted in FIGS. 7-9. Following use, watercraft 10 may be disassembled into its constituent components of first float 14, second float 18, and seating assembly 22, as shown in FIG. 7. This disassembly may occur relatively quickly and easily merely by pulling prongs 54A and 54B out of respective passages 46A and 46B (thus separating seating assembly 22 from first float 14) and pulling prongs 78A and 78B from respective passages 74A and 74B (thus detaching seating assembly 22 from second float 18).

Thereafter, seating assembly 22 may be placed into central recess 82 of second float 18 as depicted in FIG. 8. First float 14 may then be inverted and clipped (or otherwise attached) to second float 18 in the manner shown in FIG. 9 so as to produce a compact, unitary object for transport and storage. (Alternatively, of course, second float 18 could be inverted and attached to first float 14.) When watercraft 10 is next needed for use, first and second floats 14 and 18 simply may be detached, seating assembly 22 may be removed from central recess 82, and then the seating assembly 22 may be attached to the first and second floats 14 and 18 as described above.

Illustrated in FIGS. 10-14 is an alternate watercraft 100. Craft 100 may include first float 104 and second float 108 as well as seating assembly 112 comprising both seat 116 and framework 120. Similar to the analogous component of craft 10, seating assembly 112 may bridge the first and second floats 104 and 108 as shown in FIG. 10.

Figure 11:
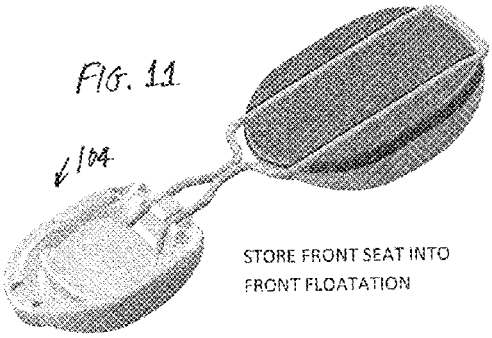
FIG. 11 illustrates a first step in compactly reassembling the watercraft of FIG. 10 following separation of a seating platform from its framework.
Figure 12:
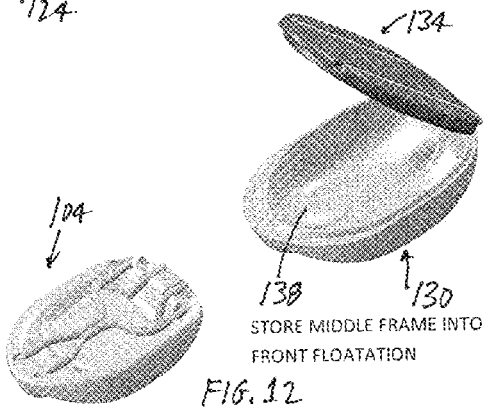
FIG. 12 illustrates a second step in compactly reassembling the watercraft of FIG. 10 following the first reassembly step of FIG. 11.

Disassembly and compact reassembly of watercraft 100 begins as shown in FIG. 11, with seat 116 being unclipped or otherwise removed from framework 120. Seat 116 may then be placed into central recess 124 of first float 104. Prongs of framework 120 may be pulled from passages of first and second floats 104 and 108 and framework 120 then placed atop seat 116 in central recess 124 (see FIG. 12). FIG. 12 also well illustrates that second float 108 may include both base 130 and cover 134, with the passages being present in the cover 134. Cover 134 advantageously may be hinged relative to base 130, although other attachment means may be employed instead.

Figure 13:
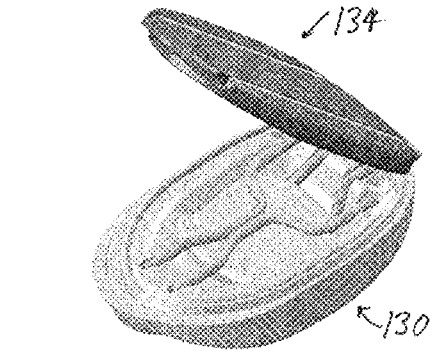
FIG. 13 illustrates a third step in compactly reassembling the watercraft of FIG. 10 following the second reassembly step of FIG. 12.
Figure 14:
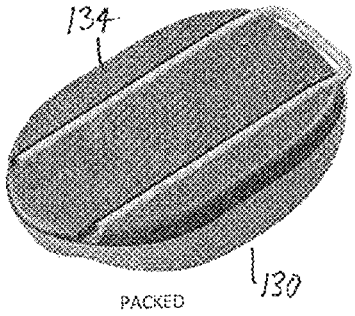
FIG. 14 illustrates a fourth step in compactly reassembling the watercraft of FIG. 10 following the third reassembly step of FIG. 13.

After seat 116 and framework 120 are positioned in central recess 124 of first float 104, the collective may be placed in central recess 138 of base 130. This placement is depicted in FIG. 13. Following the placement, cover 134 may be pivoted into the position shown in FIG. 14 so as to shield seat 116 and framework 120 and, preferably, clip or otherwise attach to base 130. Again, therefore, a unitary, compact structure may be produced.

FIGS. 15A-20 illustrate another exemplary watercraft 200. Similar to watercraft 10, craft 200 may comprise first float 204, second float 208, and seating assembly 212. If desired, watercraft 200 additionally may include other features and components described in connection with watercraft 10. As configured in the drawings, first float 204 and second float 208 are aligned in the normal travel direction T of watercraft 200, with first float 204 normally extending forward of, and second float 204 normally extending rearward of, an occupant seated on seating assembly 212.

Figures 15A, 15B, 16, 17, 18, 19, 20:
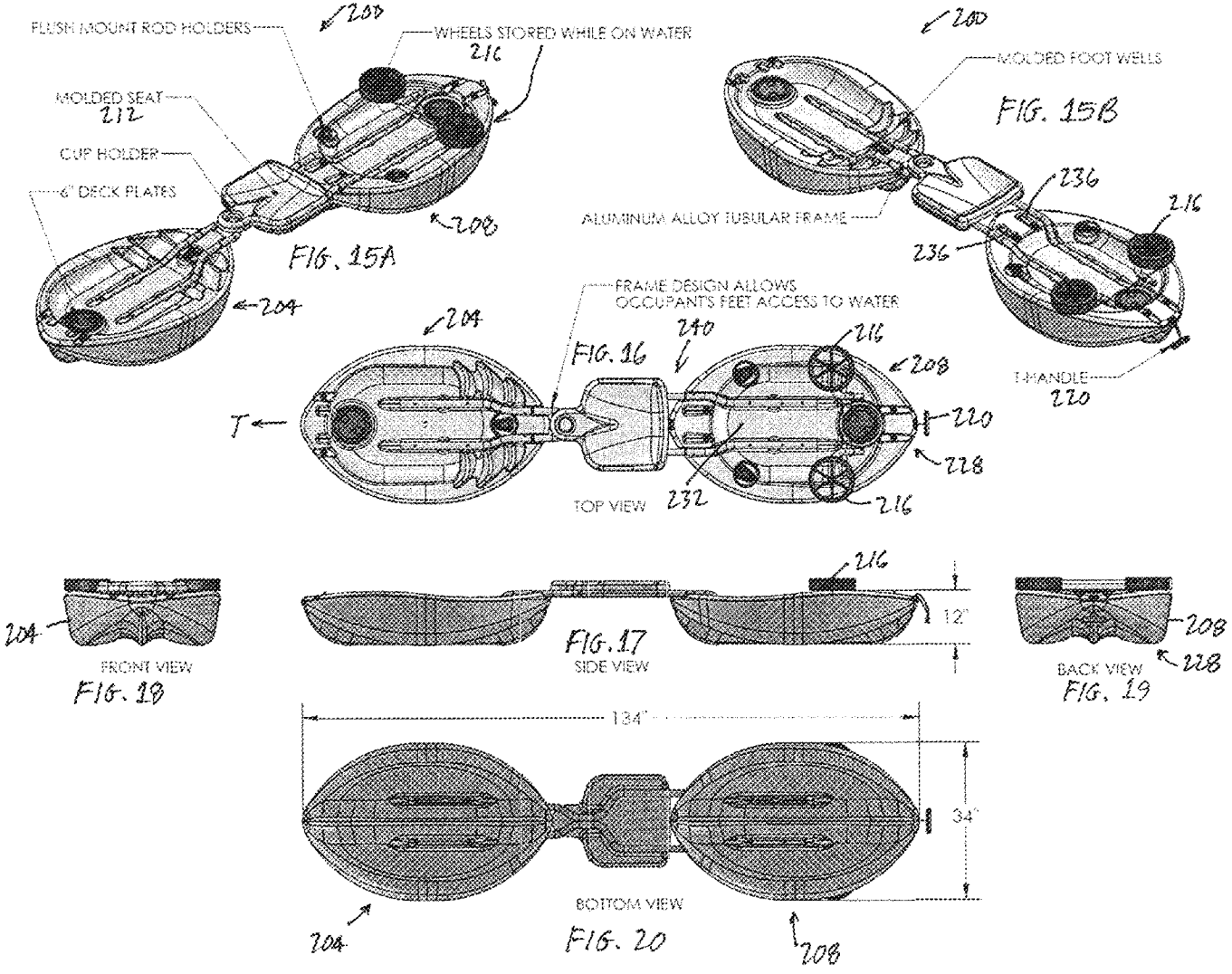
FIGS. 15A-B are perspective views of a third version of an exemplary watercraft encompassed by the present invention.
FIG. 16 is a top plan view of the watercraft of FIGS. 15A-B.
FIG. 17 is a side elevational view of the watercraft of FIGS. 15A-B.
FIG. 18 is a front elevational view of the watercraft of FIGS. 15A-B.
FIG. 19 is a rear elevational view of the watercraft of FIGS. 15A-B.
FIG. 20 is a bottom plan view of the watercraft of FIGS. 15A-B.

Also detailed in FIGS. 15A-16 are wheel assemblies 216 and handle 220 of watercraft 200. When not in use, wheel assemblies 216 conveniently may be fitted into recesses of upper portion 224 of second float 208. Handle 220, by contrast, may be connected to (nominally) rear portion 228 of second float 208. Wheel assemblies 216 and handle 220 cooperate to facilitate transport of watercraft 200 when in its compact configuration.

Figure 21:
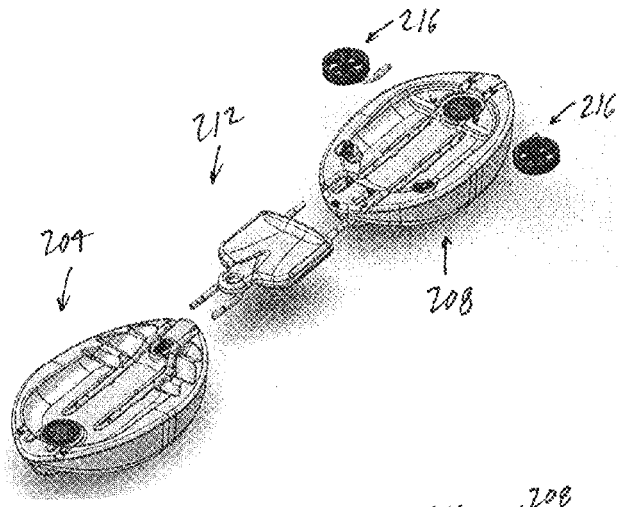
FIG. 21 is an exploded perspective view of the watercraft of FIG. 15A-B, with the seating assembly of the craft separated from the two floats.
Figure 22:
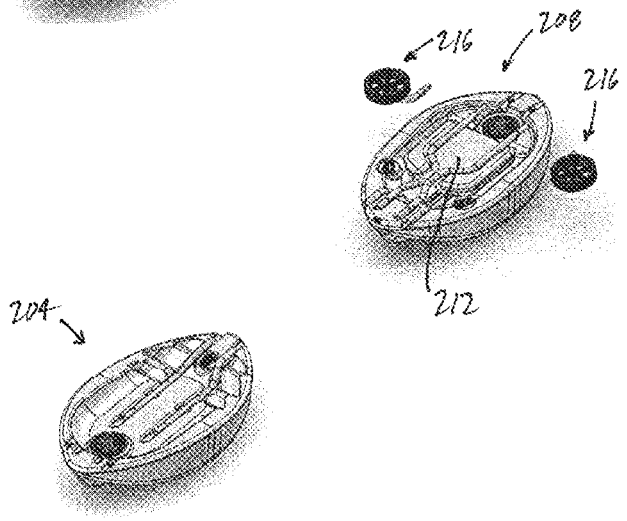
FIG. 22 illustrates a first step in compactly reassembling the watercraft of FIGS. 15A-B following the separation of FIG. 21.

As shown in FIG. 21, and similar to disassembly of watercraft 10, watercraft 200 may be disassembled by separating first float 204 and second float 208 from seating assembly 212. Seating assembly 212 thereafter may be placed into central recess 232 of second float 208 (see FIG.

Figure 23:
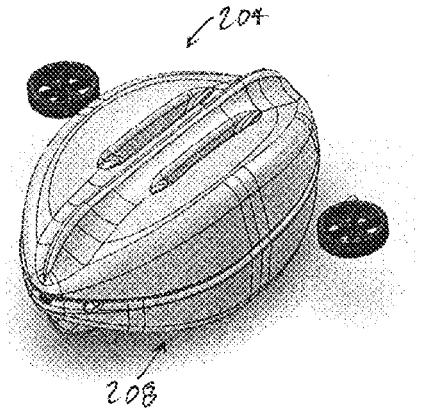
FIG. 23 illustrates a second step in compactly reassembling the watercraft of FIGS. 15A-B following the first reassembly step of FIG. 22.
Figure 24:
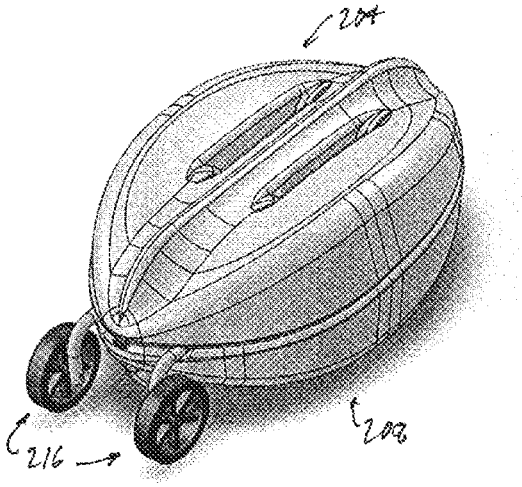
FIG. 24 illustrates a third step in compactly reassembling the watercraft of FIGS. 15A-B following the second reassembly step of FIG. 23.
Figure 25:
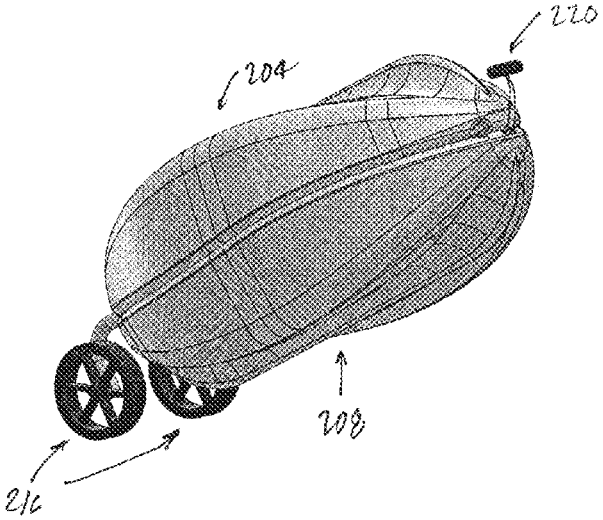
FIG. 25 illustrates a fourth step in compactly reassembling the watercraft of FIGS. 15A-B following the third reassembly step of FIG. 24.
Figures 26A, 26B, 27, 28, 29, 30, 31:
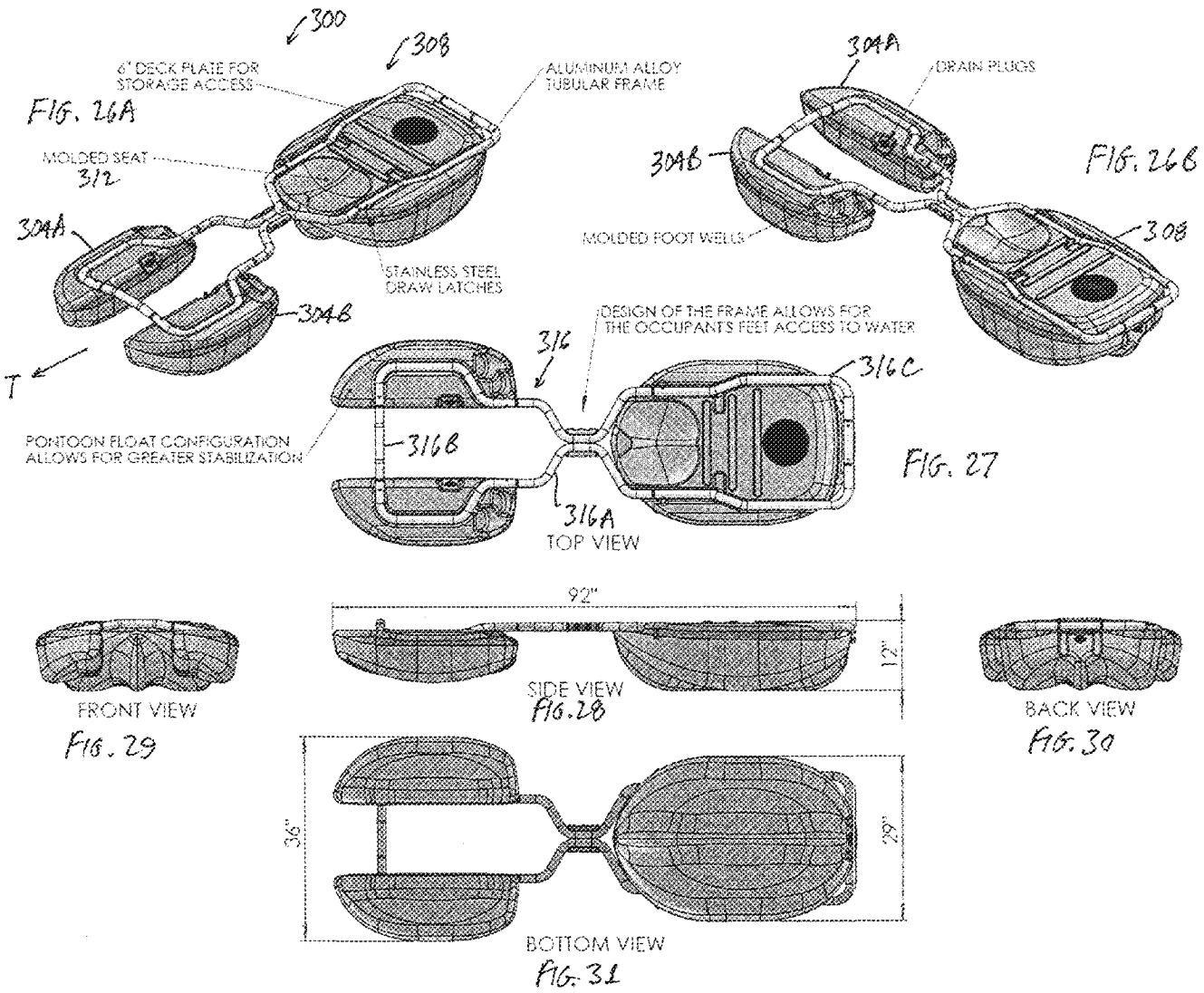
FIGS. 26A-B are perspective views of a fourth version of an exemplary watercraft encompassed by the present invention.
FIG. 27 is a top plan view of the watercraft of FIGS. 26A-B.
FIG. 28 is a side elevational view of the watercraft of FIGS. 26A-B.
FIG. 29 is a front elevational view of the watercraft of FIGS. 26A-B.
FIG. 30 is a rear elevational view of the watercraft of FIGS. 26A-B.
FIG. 31 is a bottom plan view of the watercraft of FIGS. 26A-B.

22), following which first float 204 may be inverted and attached to the second float 208 (see FIG. 23). Consistent with FIG. 24, wheel assemblies 216 may then be placed in recesses 236 of (nominally) forward portion 240 of second float 208 to produce a compact, unitary, wheeled object for transport and storage. FIG. 25 illustrates that watercraft 200 may be transported on wheel assemblies 216 merely by grasping and lifting handle 220.

Yet another exemplary watercraft 300 is shown in FIGS. 26A-39. Unlike watercraft 100, for example, watercraft 300 does not include dual, in-line flotation. Instead, watercraft 300 may include floats 304A-B and 308, with floats 304A-B being symmetric about travel direction T and float 308 being in-line with that travel direction T. Also unlike watercraft 100, watercraft 300 includes seat 312 of a seating assembly formed as part of float 308, although framework 316 of the seating assembly continues to bridge floats 304A-B and 308. Framework 316, further, includes mid-section 316A configured to be detachably connected to each of (nominally) fore section 316B and rear section 316C. Fore section 316B may assist in retaining separation of floats 304A-B, among other functions, when watercraft 300 is in use.

To disassemble watercraft 300 after use, float 308 may be disconnected from mid-section 316A (see FIG. 32). As illustrated in FIG. 33, pontoon assembly 320—comprising floats 304A-B and fore section 316B—may be disconnected from mid-section 316A. Assembly 320 itself may be separated into subcomponents by detaching cross-bar 324A from other members 324B-C of fore section 316B (see FIG. 34). FIGS. 35-36 depict that float 308 may include both base 330 and cover 334 hingedly (or otherwise) connected thereto; also illustrated is that mid-section 316A may be clipped to underside 338 of cover 334 for storage after draw latches (or similar) on base 330 are released and cover 334 is raised.

Shown in FIG. 37 is that cross-bar 324A may be fitted into central recess 342 of base 330. Thereafter floats 304A and 304B, together with their respective associated members 324B and 324C, may be stored side-by-side in central recess 342 (see FIG. 38). If cover 334 is then closed and latched, another unitary, compact structure is produced.

The foregoing is provided for purposes of illustrating, explaining, and describing embodiments of the present invention. Modifications and adaptations to these embodiments will be apparent to those skilled in the art and may be made without departing from the scope or spirit of the invention.

What is claimed is:

1. Watercraft comprising:

a. a first float defining a first recess and comprising at least one first passage;

b. a second float comprising at least one second passage; and c. a seating assembly (i) including a seat and a framework comprising prongs and (ii) which, in a first configuration, is connected to the first float and the second float for use by frictionally fitting the prongs into the first and second passages and in a second configuration (A) is disconnected from the second float and (B) has at least a portion positioned within the first recess.

2. Watercraft according to claim 1 in which, in the second configuration, the seating assembly also is covered by the second float, which second float is attached to the first float.

3. Watercraft according to claim 1 in which (i) the second float comprises a cover and (ii) in the second configuration, the seating assembly also is covered by the cover, which cover also covers the first float.

4. Watercraft according to claim 1 in which the seating assembly, in the first configuration, is longitudinally aligned with the first and second floats in a nominal travel direction of the watercraft.

5. Watercraft comprising:

a. a first float defining a first recess;

b. a second float;

c. a seating assembly which, in a first configuration, is connected to the first float and the second float for use and in a second configuration (i) is disconnected from the second float and (ii) has at least a portion positioned within the first recess; and d. a third float which, in the first configuration, is (i) connected to the seating assembly and (ii) longitudinally unaligned with either of the first or second floats.

6. Watercraft according to claim 4 in which the first and second floats are formed of rigid plastic material.

7. Watercraft according to claim 1 in which at least one of the first and second floats defines foot wells for an occupant of the watercraft seated on the seating assembly.

8. Watercraft according to claim 5 in which at least two of the first, second, and third floats define foot wells for an occupant of the watercraft seated on the seating assembly.

9. Watercraft according to claim 7 having a footprint and being configured in use to allow the occupant to position his or her feet outside the footprint into water in which the watercraft is placed.

10. Watercraft according to claim 1 in which the framework is attached to the seat in at least the first configuration.

11. Watercraft comprising:

a. a first float defining a first recess;

b. a second float;

c. a seating assembly which, in a first configuration, is connected to the first float and the second float for use and in a second configuration (i) is disconnected from the second float and (ii) has at least a portion positioned within the first recess; and d. at least one wheel connected to at least one of the first and second floats.

12. Watercraft according to claim 11 in which the at least one wheel comprises two wheels, further comprising a handle connected to at least one of the first and second floats.

13. Watercraft comprising:

a. a first float defining a first recess;

b. a second float; and c. a seating assembly which, in a first configuration, is connected to the first float and the second float for use and in a second configuration (i) is disconnected from the second float and (ii) has at least a portion positioned within the first recess; and in which (i) the first float comprises a cover and (ii) in the second configuration, at least part of the seating assembly is covered by the cover, which cover also covers the second float.

14. Watercraft according to claim 5 in which (i) the first float comprises a cover and (ii) in the second configuration, at least part of the seating assembly is covered by the cover, which cover also covers the second and third floats.

15. A method of reconfiguring a watercraft comprising a seating assembly attached to first and second floats, the method comprising:

a. detaching at least part of the seating assembly from the first and second floats;

b. positioning the at least part of the seating assembly in a recess of the first float; and c. either (i) attaching the first and second floats so as to shield the at least part of the seating assembly or (ii) placing the first float and the at least part of the seating assembly in a recess of the second float and thereafter covering the first float and the seating assembly.

* * * * *